United States Patent [19]

Yocca

[11] 3,987,996

[45] Oct. 26, 1976

[54] COMBINATION HASSOCK AND CHRISTMAS TREE HOLDER

[75] Inventor: Peter A. Yocca, Salisbury, Md.

[73] Assignee: The Raymond Lee Organization, Inc., a part interest

[22] Filed: Oct. 23, 1975

[21] Appl. No.: 625,313

[52] U.S. Cl. ..... 248/524; 297/129

[51] Int. Cl.[2] ..... A01K 97/10

[58] Field of Search ..... D6/105; 248/44–48, 248/519–529; 297/129, 439

[56] References Cited

UNITED STATES PATENTS

| | | | |
|---|---|---|---|
| 1,600,687 | 9/1926 | Mantz | D6/105 |
| 1,694,815 | 12/1928 | Garlick | 248/521 X |
| 1,769,127 | 7/1930 | Finnegan | 248/529 X |
| 1,914,150 | 6/1933 | Muldoon | 248/44 |
| 1,914,440 | 6/1933 | Larson | 297/129 X |
| 1,971,300 | 8/1934 | Garrett | 248/45 |
| 1,988,343 | 1/1935 | Tacy | 248/45 |
| 2,190,544 | 2/1940 | Jarnagin | 248/44 |
| 2,416,802 | 3/1947 | Roung | 248/45 |
| 2,617,617 | 11/1952 | Krastel et al. | 248/44 |
| 2,630,994 | 3/1953 | Dicoskey | 248/527 X |
| 2,867,398 | 1/1959 | Rose | 248/44 |
| 2,956,357 | 10/1960 | Rakes | 248/349 UX |
| 3,116,096 | 12/1963 | Kavanagh | 248/524 X |
| 3,250,504 | 5/1966 | Schwaderlapp | 248/44 |
| 3,526,379 | 9/1970 | Schwaderlapp | 248/44 |
| 3,582,028 | 6/1971 | Purdy | 248/523 X |
| 3,815,853 | 6/1974 | Bahner | 248/524 |
| D115,902 | 8/1939 | Barton | D6/105 |
| D187,542 | 3/1960 | Cosentino | 248/44 X |

FOREIGN PATENTS OR APPLICATIONS

| | | | |
|---|---|---|---|
| 618,971 | 3/1961 | Italy | 248/44 |

*Primary Examiner*—Lawrence J. Staab

[57] ABSTRACT

A cylindrical housing is decorated to resemble a drum or is upholstered to form a hassock. When the top of the housing is removed, a central hole is revealed. Inside the hassock is a holder for the trunks of Christmas trees. The trunk can be inserted through the holder and held upright in the device. The holder can be fitted to make the tree stand vertically even though the housing is not on a level floor.

1 Claim, 5 Drawing Figures

COMBINATION HASSOCK AND CHRISTMAS TREE HOLDER

SUMMARY OF THE INVENTION

This invention provides a holder for Christmas trees that can, when covered, serve as a useful hassock. Essentially, the invention has a decorative housing that encloses a holder for the tree. For use as a tree holder the top of the housing may be lifted off and the tree introduced in the holder. After use, the tree may be removed and the top replaced, for enabling the device to be used as a hassock.

DETAILED DESCRIPTION OF THE PREFERRED EMBODIMENT

Figure 1:
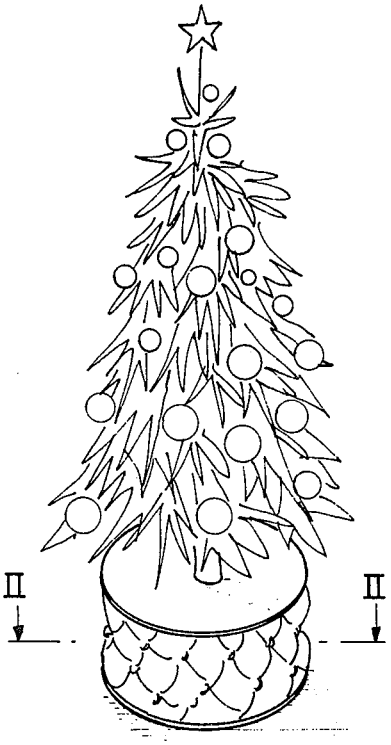
FIG. 1 shows the invention in use as a tree holder.
Figure 2:
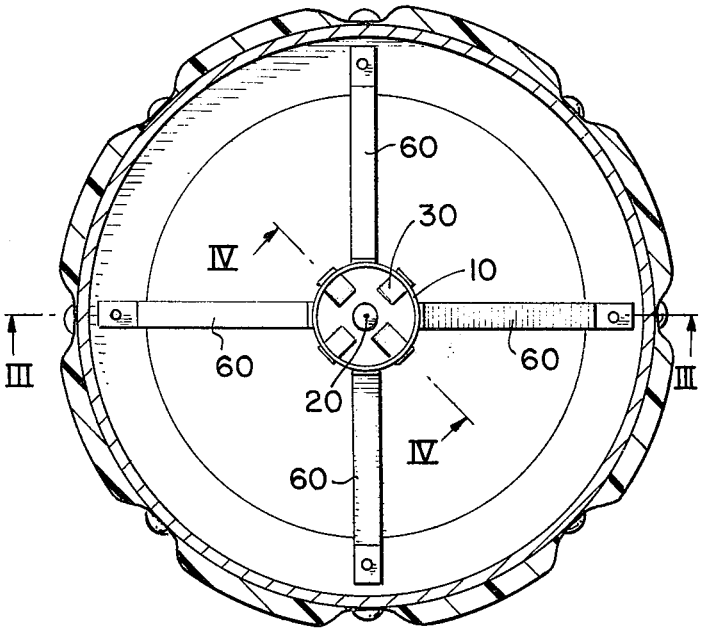
FIG. 2 is a view along line II—II of FIG. 1.
Figure 3:
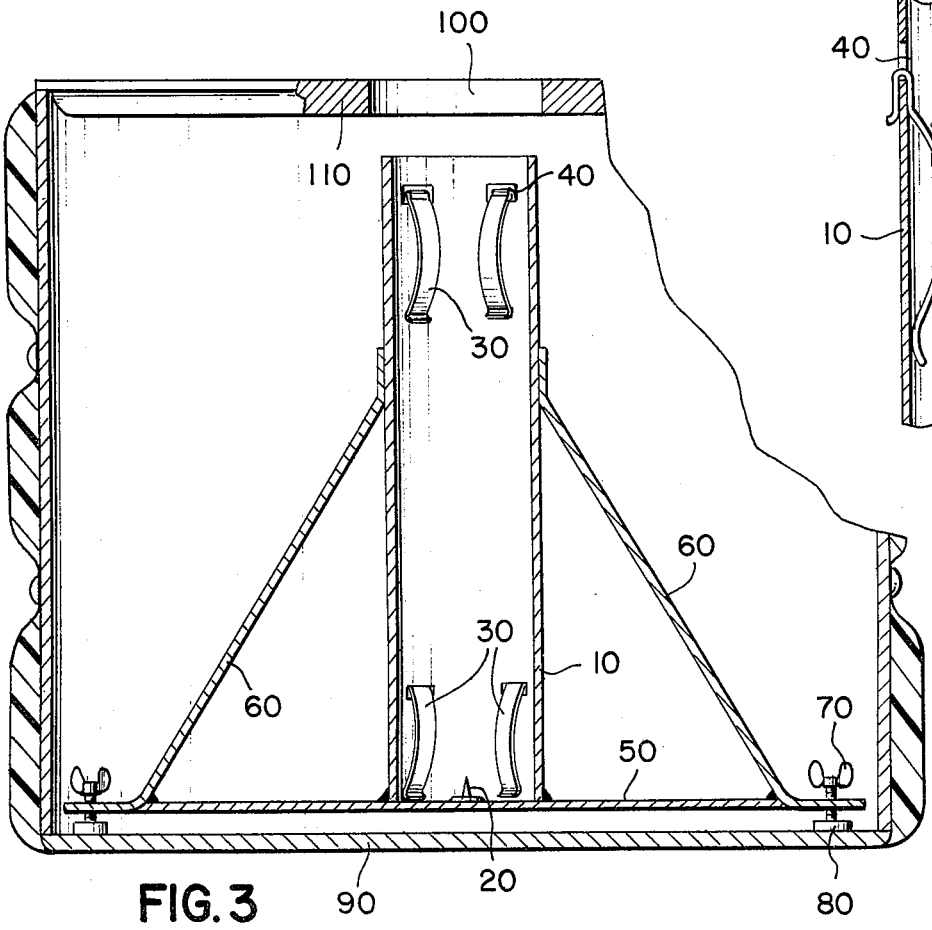
FIG. 3 is a view along line III—III of FIG. 2.
Figure 4:
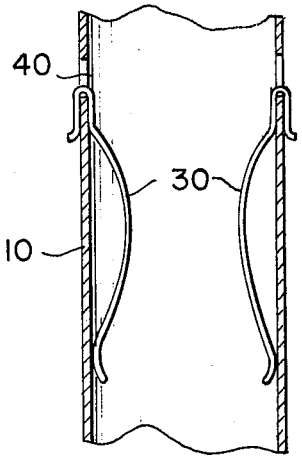
FIG. 4 is a view along line IV—IV of FIG. 2.

A vertically elongated cylinder 10 has an open top and a closed bottom, with a tack 20 attached to the bottom of the cylinder, point upwardly. Two rings of four springs 30 are attached to the cylinder. One ring near the top and one ring near the bottom. The springs are inwardly bowed leaf springs made from bent strips of metal that are clipped to the cylinder through holes 40 at their top ends and are free at their bottom ends. It can be seen that a tree trunk will, when introduced into the cylinder through the top, flatten the springs towards the inner wall of the cylinder, tending to hold the trunk upright within the cylinder. The tack stabs into the lower end of the trunk to help achieve the same end.

Four like arms 50 extend radially outwardly from the bottom of the cylinder, to form a cross. Elongated brackets 60 extends upwardly and inwardly towards its point of attachment to the cylinder from each arm, to brace the cylinder from tipping to the side with respect to the arms.

At the outward end of each arm is located a wingnut type height adjuster, with a wingnut 70 and a base 80. The wingnut is threaded vertically into a tapped hole in the arm, and the base is pivotally secured to the bottom of the wingnut, below the arm. It can be seen that the cylinder can be tilted to a vertical position by operating the adjusters, if the surface upon which the device has been placed is not level.

The whole assembly described above is placed in the interior of a hollow cylindrical housing 90. The bottom of the housing is closed, but the top has a hole 100 that is larger than the diameter of the cylinder. It can be seen that a tree trunk can be placed through the hole into the cylinder, and that the cylinder can be adjusted to a vertical position by operating the adjusters. The top 110 of the housing is merely a lid that can be removed to allow access to the adjusters.

Figure 5:
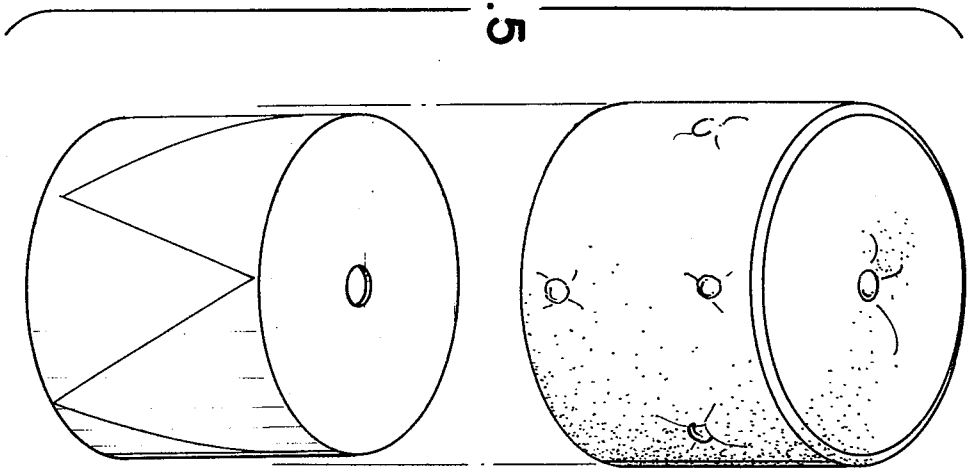
FIG. 5 is a drawing of two embodiments of the housing used in the invention.

The housing and lid may be decorated to resemble a drum, as in the lower portion of FIG. 5. Alternatively, the housing and lid can be upholstered to form a hassock, as is shown in FIG. 5 on the top. If desired, a disc (not shown) can support a downwardly hanging fabric skirt (not shown) to cover the housing, if the expense of an upholstered model is too great for the user and a decorated, drum-like appearance is not desired.

I claim:

1. A combination hassock and Christmas tree holder, comprising:

a vertically elongated hollow cylinder for holding the trunk of a tree, the cylinder being open at the top and closed at the bottom;

eight like inwardly bowed, vertically elongated leaf type springs attached to the cylinder at their upper ends with their lower ends being free to move, the springs being arranged in two rings of four;

a hollow cylindrical housing holding the cylinder completely inside its interior, the housing having an axis collinear with the axis of the cylinder having a closed bottom, and having a control hole above the cylinder that is larger in diameter than the diameter of the cylinder and that is generally aligned therewith; and levelling means cooperating with the cylinder and housing to allow the axis of the cylinder to be tilted with respect to the axis of the housing, the levelling means including four like elongated arms extending radially outwardly from the cylinder in a cross, and four like wingnut type height adjusters, each adjuster being threaded into the end of a corresponding arm.

* * * * *